US012426690B2

(12) United States Patent
Howe et al.

(10) Patent No.: US 12,426,690 B2
(45) Date of Patent: Sep. 30, 2025

(54) COLLAPSIBLE TRAVEL BAGS AND CASES

(71) Applicant: Orucase, LLC, San Diego, CA (US)

(72) Inventors: Isaac W. Howe, San Diego, CA (US); Colin S. Jaskiewicz, San Diego, CA (US)

(73) Assignee: ORUCASE, LLC, San Diego, CA (US)

( * ) Notice: Subject to any disclaimer, the term of this patent is extended or adjusted under 35 U.S.C. 154(b) by 109 days.

(21) Appl. No.: 18/138,636

(22) Filed: Apr. 24, 2023

(65) Prior Publication Data

US 2023/0337797 A1 Oct. 26, 2023

Related U.S. Application Data

(60) Provisional application No. 63/334,438, filed on Apr. 25, 2022.

(51) Int. Cl.

| | |
|---|---|
| ***A45C 7/00*** | (2006.01) |
| ***A45C 5/14*** | (2006.01) |
| ***A45C 13/00*** | (2006.01) |
| ***A45C 13/04*** | (2006.01) |
| ***A45C 13/10*** | (2006.01) |

(52) U.S. Cl.

CPC ..... *A45C 7/0036* (2013.01); *A45C 5/14* (2013.01); *A45C 13/005* (2013.01); *A45C 13/04* (2013.01); *A45C 13/103* (2013.01)

(58) Field of Classification Search

CPC ..... A45C 7/0036; A45C 5/14; A45C 13/005; A45C 13/04; A45C 13/103

USPC ..... 190/103

See application file for complete search history.

(56) References Cited

U.S. PATENT DOCUMENTS 968,479 A * 8/1910 Jensen ..... A45C 7/0031 273/286
4,790,256 A * 12/1988 Levine ..... B60R 9/055 224/406
2014/0353104 A1* 12/2014 Sheikh ..... A45C 7/0022 190/119
2022/0371816 A1* 11/2022 Pleasants ..... A45C 13/005

FOREIGN PATENT DOCUMENTS

CN 208540847 U * 2/2019 ..... A45C 11/00
EP 3332921 A1 * 6/2018 ..... B25H 3/006
WO WO-2019168409 A1 * 9/2019 ..... A45C 11/00

OTHER PUBLICATIONS

Brian Delaney, "Gallery: Orucase Axiom fold-down bike travel case with air-padded protection panels" Apr. 7, 2022. URL: https://velo.outsideonline.com/gallery/gallery-orucase-axiom-fold-down-bike-travel-case-with-air-padded-protection-panels. 6 pages.

Anonymous "Orucase Airport Ninja" Mar. 20, 2022. URL: https://velo.outsideonline.com/gear/apparel-accessories/orucase-airport-ninja. 7 pages.

* cited by examiner

*Primary Examiner* — Don M Anderson
*Assistant Examiner* — Jessica Kavini Tamil
(74) *Attorney, Agent, or Firm* — Procopio, Cory, Hargreaves & Savitch LLP

(57) ABSTRACT

Collapsible travel cases are provided herein. In some aspects, the collapsible travel case is configured to store a bicycle when the collapsible case is in an expanded configuration. In some aspects, the collapsible travel case comprises a base that is configured to fold at a joint via a hinge assembly.

15 Claims, 15 Drawing Sheets

COLLAPSIBLE TRAVEL BAGS AND CASES

CROSS-REFERENCE TO RELATED APPLICATIONS

This application claims priority to U.S. Provisional Patent Application No. 63/334,438, filed on Apr. 25, 2022. This and all other extrinsic materials discussed herein, including publications, patent applications, and patents, are incorporated by reference in their entirety. Where a definition or use of a term in an incorporated reference is inconsistent or contrary to the definition of that term provided herein, the definition of that term provided herein applies and the definition of the term in the reference does not apply.

TECHNICAL FIELD

The present disclosure relates to collapsible travel bags and cases.

BACKGROUND

Travel cases, especially those that are used to travel with bicycles or other large objects, can be large and cumbersome for storage and for travel. Airports, train stations, hallways and streets are often crowded, making it difficult to move through them with large cases. Where a case is too large to fit into a home, hotel or other dwelling closet, the case may need to be left out in the open, taking up a large amount of space in a living room, bedroom, hallway, or other areas.

SUMMARY

Accordingly, collapsible cases are provided herein, which advantageously make it easier to travel with bicycles and other large objects.

In an aspect of the disclosure, a collapsible case is provided comprising a base having a first base portion movably (e.g., foldably, rotatably, pivotably) coupled to a second base portion, and a frame assembly (also referred to herein as a frame) configured to be coupled to the base. The first base portion can comprise a first lower surface portion, a first upper edge portion, a first side wall portion, and a first compartment sized and dimensioned for storing at least a first portion of the frame. The second base portion can comprise a second lower surface portion, a second upper edge portion, a second side wall portion, and a second compartment sized and dimensioned for storing at least a second portion of the frame. In some embodiments, the first portion of the frame assembly comprises a first extrusion and a second portion of the frame assembly comprises a second extrusion. In some embodiments, a central slider is positioned within a lumen or cavity of the first extrusion and configured to slide in and out of a lumen or cavity of the second extrusion. In some embodiments, a hinge assembly is provided comprising a first side component (or leaf) having a first set of knuckles, a second side component (or leaf) having a second set of knuckles, and a pin inserted through the center of the first and second knuckles such that the side portions can move (e.g., rotate) relative to one another while held together at the knuckles via the pin. The first side component of the hinge assembly can secure and anchor the first extrusion within the first compartment of the base, and the second side component of the hinge assembly can secure and anchor the second extrusion within the second compartment of the base such that they are aligned (form a 180 degree angle or straight line) when in an open configuration. The first and second base portions can comprise openings aligning with the lumen/cavity of each of the first and second extrusions when the collapsible case is in an open configuration such that the central slider can slide from within the first extrusion to be at least partially within the second extrusion.

The frame assembly can further comprise additional components that can be stored within the compartments of the collapsible case in a closed configuration and assembled to extend out of the compartments when in an open configuration (e.g., to frame a bicycle or bicycle frame). Additionally or alternatively, the frame assembly can comprise additional components that are coupled to the first and second extrusions and can be folded/collapsed to fit within the compartments in a closed configuration and unfolded/extended to extend out of the compartments when in an open configuration.

In some embodiments, each of the first and second base portions are substantially the same size. In some embodiments, each of the first and second base portions has a general rectangular vessel shape, which can optionally include rounded corners, ridges, grooves, etc. The base is adjustable from a collapsed configuration (also referred to herein as a closed configuration) where the first and second upper edge portions face one another and are each positioned between the first lower surface portion and the second lower surface portion, to an open configuration where the first upper edge portion is positioned above the first lower surface portion, and the second upper edge portion is positioned above the second lower surface portion.

A first fastener coupled to the base can be provided, and configured to fasten the first and second base portions to one another in the collapsed configuration. For example, a zipper can be provided where a first tape side having a first set of teeth is attached to the first base portion (e.g., along the first upper edge portion), a second tape side having a second set of teeth is attached to the second base portion (e.g., along the second upper edge portion), and when the case is in a closed configuration such that the first and second upper edge portions are aligned, the first and second sets of teeth can engage one another when passed through the zipper slider. In some embodiments, a zipper can extend around all or substantially all (at least 90%) of the length of each of the first and second upper edge portions. In some embodiments, two or more zippers or other fasteners can be provided to fasten the first and second base portions to one another in the collapsed configuration. It should be appreciated that the fastener(s) configured to fasten the first and second base portions together can comprise any suitable fasteners, including draw latches and locking fasteners.

In some embodiments, a locking fastener can be coupled to the base, and configured to secure the first and second base portions in the open configuration. The locking fastener can comprise a slider (e.g., a central slider of the frame assembly) that extends through openings in the first and second base portions to prevent the open case from being closed. In some embodiments, a locking fastener can comprise a sliding lock or other fastener coupled to outer surfaces of the base portions (e.g., rather than being within compartments). For example a locking fastener can comprise a barrel bolt with catch plate coupled to a first base portion, and a slide bolt coupled to a second base plate that is configured to slide into the catch plate of the first base portion, for example, when the collapsible case is in an open configuration aligning the catch plate and slide bolt.

In some embodiments, the collapsible case comprises first and second base portions that are movably coupled to one another via any suitable rotation mechanism such as a hinge assembly (e.g., at a joint). The hinge assembly can comprise any suitable type of hinge, including a mortise hinge (butt hinge), a case hinge, a piano hinge, a torque hinge, a flag hinge, a spring loaded hinge, and/or a geared hinge. In some embodiments, a hinge assembly can comprise a first side or leaf portion and a second side or leaf portion that are held together at or by a pin (e.g., a pin that is inserted through the center of the knuckle(s) of side portions to hold the side portion together). The hinge assembly can advantageously, among other things, provide a mechanism that allows the case to fold in half, align the spine of the case, anchor the handle and/or other components in place, and/or provide rib support to withstand impact.

In some embodiments, the joint and/or hinge can be positioned at a mid-portion of the base when the base is in an open configuration (e.g., where the first and second base portions are the same length). In some embodiments, the base is configured to fold at the joint and/or hinge from an open configuration to the closed configuration, and a length of the base in the open configuration is at least 150%, or about 200% of a length of the base in the collapsed configuration.

In some embodiments, a collapsible case can comprise a frame assembly having a first portion and a second portion that can be assembled to form a complete frame for a bicycle (or bicycle frame). In some embodiments, the entire frame assembly can be disassembled to fit within the compartments of the first and second bases when the collapsible case is in a collapsed configuration. In some embodiments, the frame assembly can be assembled such that it extends out from the base in an open configuration, and is configured to frame and/or protect an object (e.g., bicycle, bicycle frame) held in the collapsible case. In some embodiments, the first frame portion and the second frame portion can be assembled and adjustable (e.g., to fold down to fit within the compartment for a closed case configuration, and to unfold and extend up and out of the compartments when in an open case configuration. Viewed from another perspective, in the storage configuration, the frame structure can be folded down and/or disassembled and fit within the compartment(s) of the collapsed case. In some aspects, the collapsible case can hold an assembled bicycle (e.g., bicycle frame without the wheels) and optionally the wheels (e.g., separate from the otherwise assembled bicycle, as part of the fully assembled bicycle) when the case is in an open configuration and the frame assembly is assembled and/or unfolded/expanded. In some embodiments, an upper is provided and coupled to the base (e.g., attached to the base, removably coupled to the base via one or more fasteners, such as zippers, hook and loop, snaps). The upper can comprise any suitable material(s), including a hard plastic, a fabric, or any other suitable material(s). The upper can be configured to extend from the base and form a covering for an item stored in the case (e.g., a bicycle). The frame, when extended and/or assembled for the use configuration, can hold the bicycle upright on the base, and the upper can cover the bicycle and frame. In some embodiments, the first compartment is further sized and dimensioned for storing at least a first portion of the upper. In some embodiments, the second compartment is further sized and dimensioned for storing at least a second portion of the upper. In some embodiments, the upper is configured to be fully enclosed in the case when the base is in the collapsed configuration, and to extend from the base to form a covering when the base is in the open configuration. In some embodiments, the case is sized and dimensioned to fully enclose a bicycle frame when the base is in an open configuration, and the upper is fully extended from the base to form the covering. In some embodiments, the upper comprises an upper fastener (e.g., a zipper, snaps, buttons, hook and loop).

In some embodiments, a handle is configured to couple to at least one of the first and second base portions. The handle can be movably coupled such that it can rotate and/or pivot (e.g., about 90 degrees) between a use and store configuration. The first and/or second base portions can comprise a recessed portion sized and dimensioned to receive a portion of the handle. In some embodiments, each of the first and second base portions comprises a recessed portion, and the recessed portions are positioned, sized and dimensioned to face one another and sandwich the handle when the base is in the open configuration. In some embodiments, the recessed portions can be formed by and/or part of external covers coupled to or forming part of the base portions. In some embodiments, the handle can be secured to an external cover.

In some embodiments, wherein in the collapsed configuration, the first base portion and the second base portion form two sides of a closed case, wherein the closed case has a top portion comprising a first opening and a second opening, and wherein in the open configuration, the first opening and the second opening align such that a portion of a locking fastener (e.g., a central slider of a frame) can slide from within the first compartment through the first and second openings and into the second compartment to lock the base in the open configuration.

In another aspect of the disclosure, a collapsible case is provided comprising a base having a front end, a rear end opposite the front end, a first portion comprising the front end, and a second portion comprising the rear end, wherein the first portion and second portion are slidably coupled to one another, and wherein a length of the base in a slide-out configuration is at least 150% (or at least 175%, at least 190%, at least 200%) a length of the base in a slide-in configuration. An upper and/or a frame structure can be coupled to the base. In some aspects, a bottom surface of the second portion (e.g., at least 50%, at least 60%, at least 70%, at least 80%, or at least 90% of the bottom surface of the second portion) can be positioned above a bottom surface of the first portion in the slide-in configuration. In some aspects, a first frame portion of the frame structure can be folded down and positioned below a bottom surface of the second portion of the base in the slide-in configuration. In some aspects, a bottom surface of the first portion can be positioned above a bottom surface of the second portion in the slide-in configuration. In some aspects, a second frame portion of the frame structure can be folded down and positioned below a bottom surface of the first portion of the base in the slide-in configuration.

The collapsible cases described herein can advantageously provide a case that is longer and/or otherwise larger when in use to store an object (e.g., a bike or other large object) than when stored or transported with the object removed from the case. For example, a collapsible case for a bicycle can have a length of between 40-80, 45-65, or 50-60 inches (along longest portion) when used to transport a bicycle, and be between 10-45, 15-35, or 20-30 inches (along longest portion) when stored without a bicycle.

It should be appreciated that while the disclosure herein is generally directed to cases for bicycles, the collapsible cases described herein can be used for any suitable objects, including, for example, surfboards, sporting goods, and musical instruments.

As used herein, the term "collapsible case" should be interpreted broadly to include fold-down cases, slide to collapse cases, and other cases with folding, sliding and/or otherwise adjusting parts such that the case can be made smaller (e.g., for storage) than when expanded (e.g., for use in storing or transporting of an object).

Other advantages and benefits of the disclosed compositions and methods will be apparent to one of ordinary skill with a review of the following drawings and detailed description.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

Figure 1A:
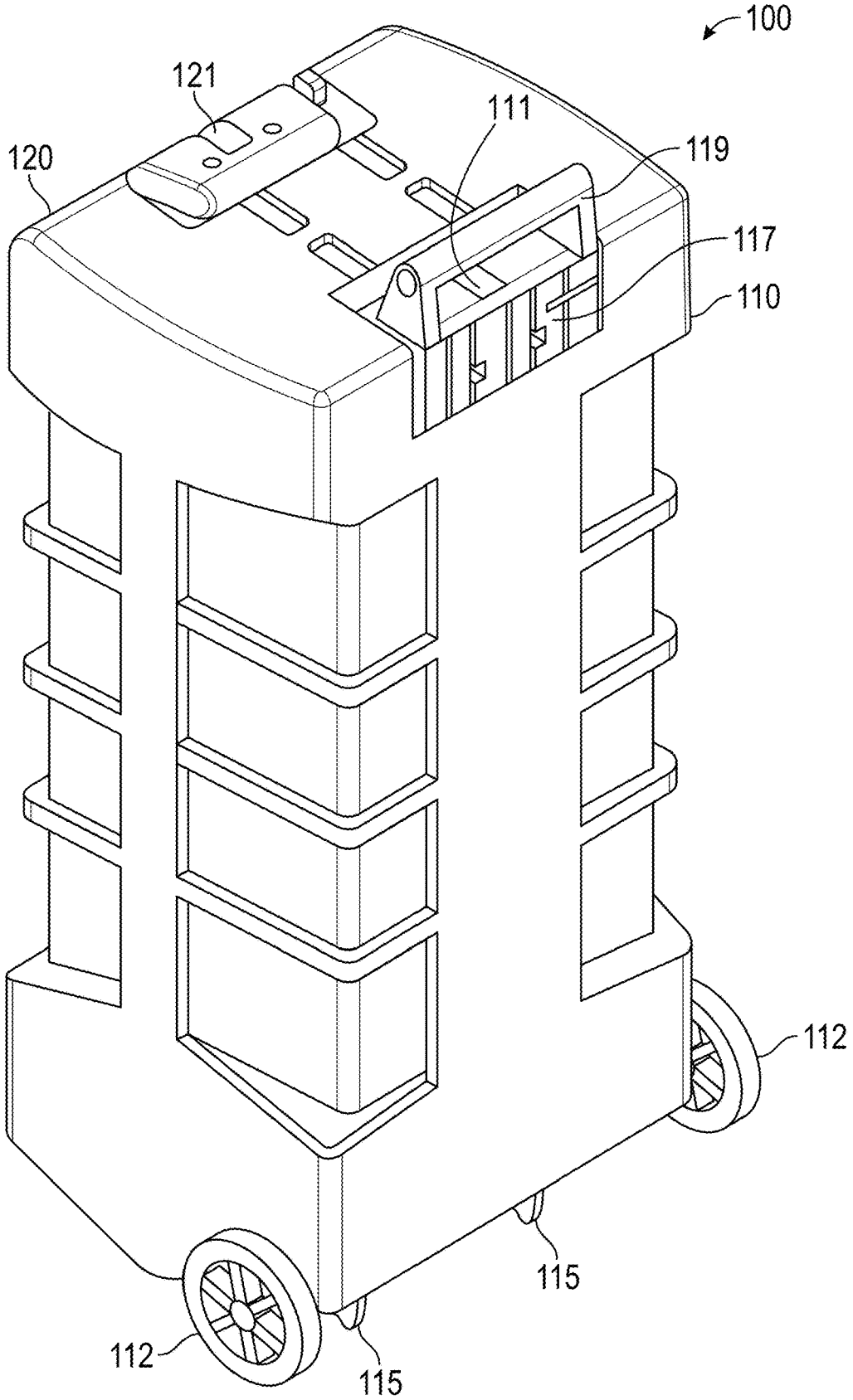
FIG. 1A is a rear side perspective view of a collapsible case in a collapsed configuration, according to an embodiment.
Figure 1B:
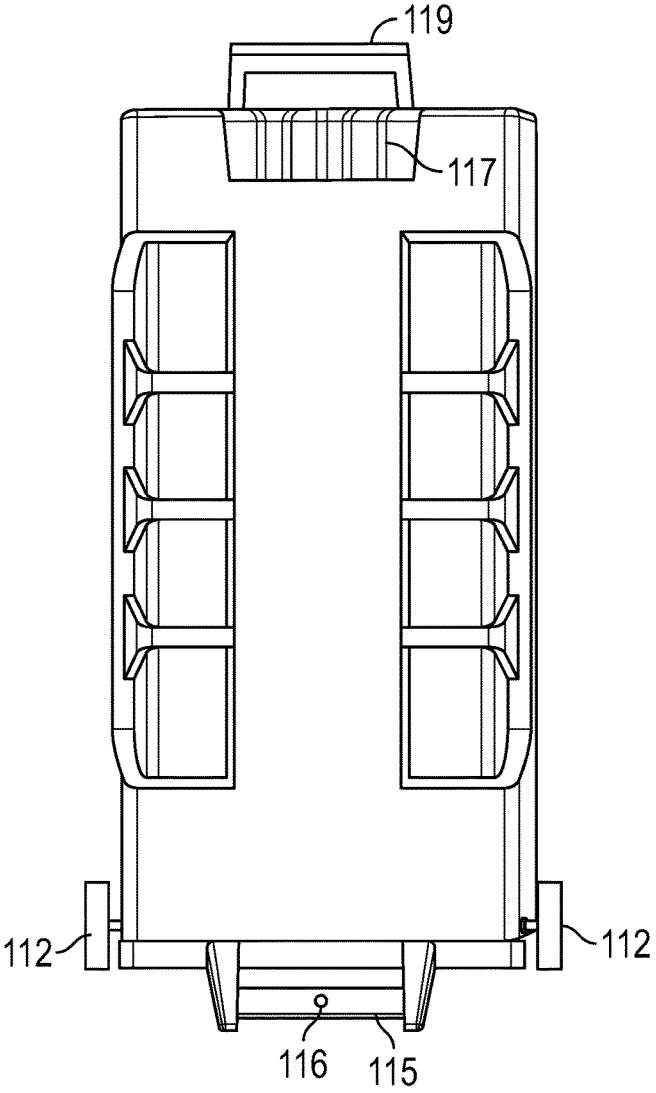
FIG. 1B is a rear view of the collapsible case of FIG. 1A.
Figure 1C:
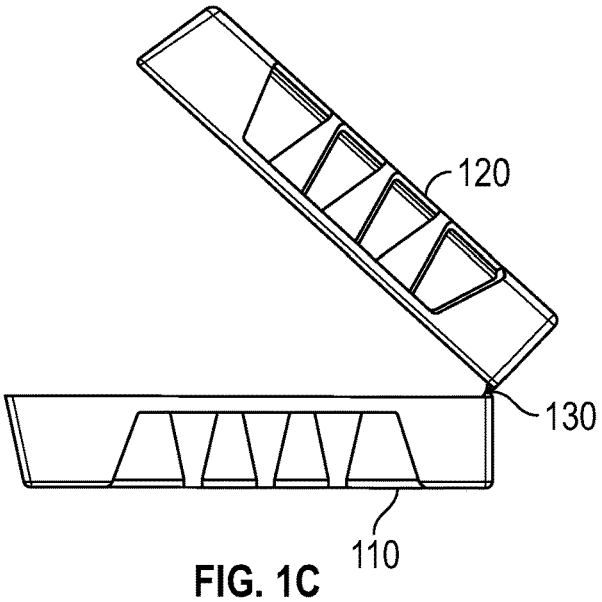
FIG. 1C illustrates first and second base portions of the collapsible case of FIG. 1A being adjusted between a closed configuration and an open configuration.
Figure 1D:
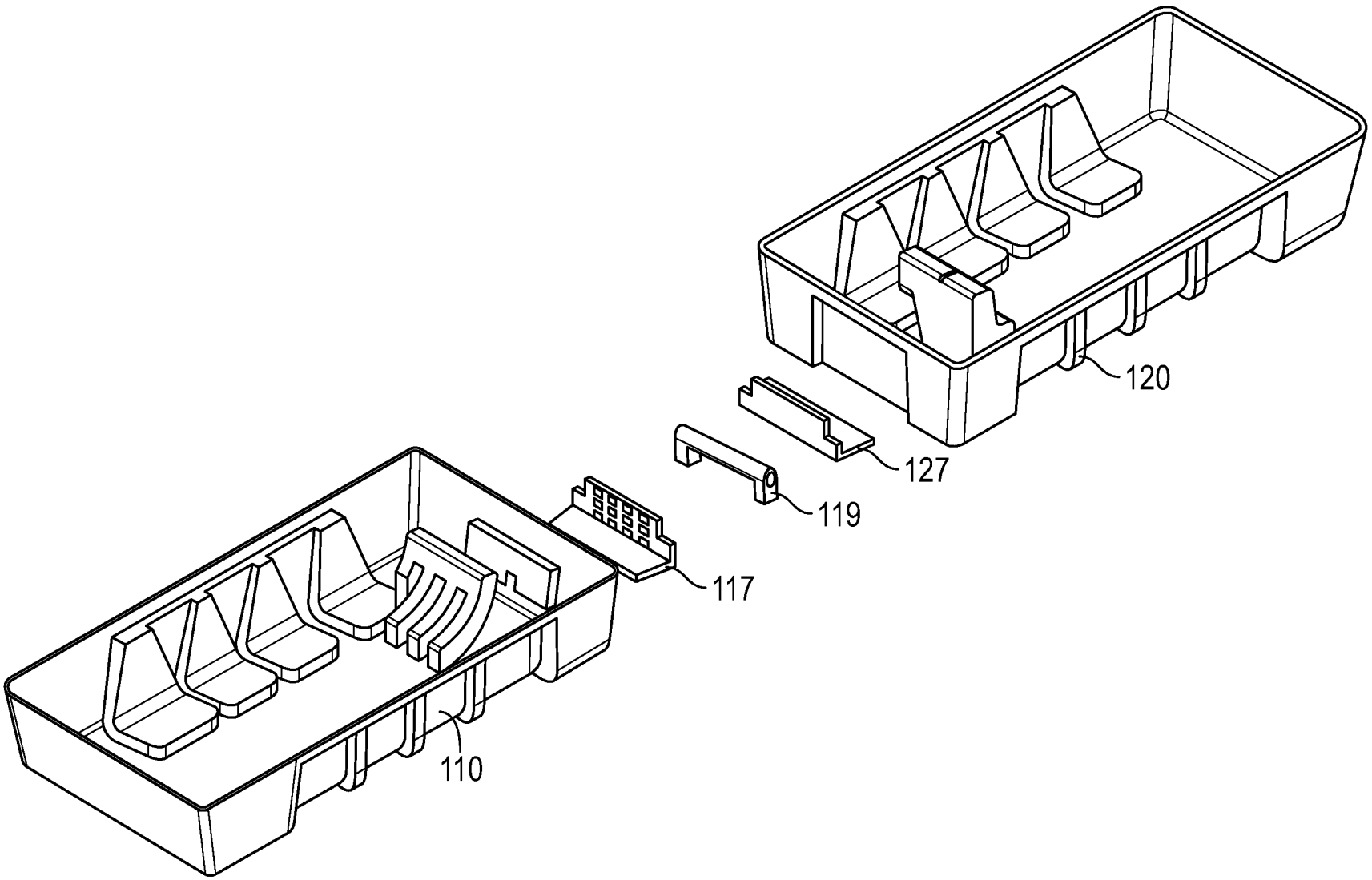
FIG. 1D is an exploded view showing the first and second base portions of the collapsible case of FIG. 1A with a handle assembly.
Figure 1E:
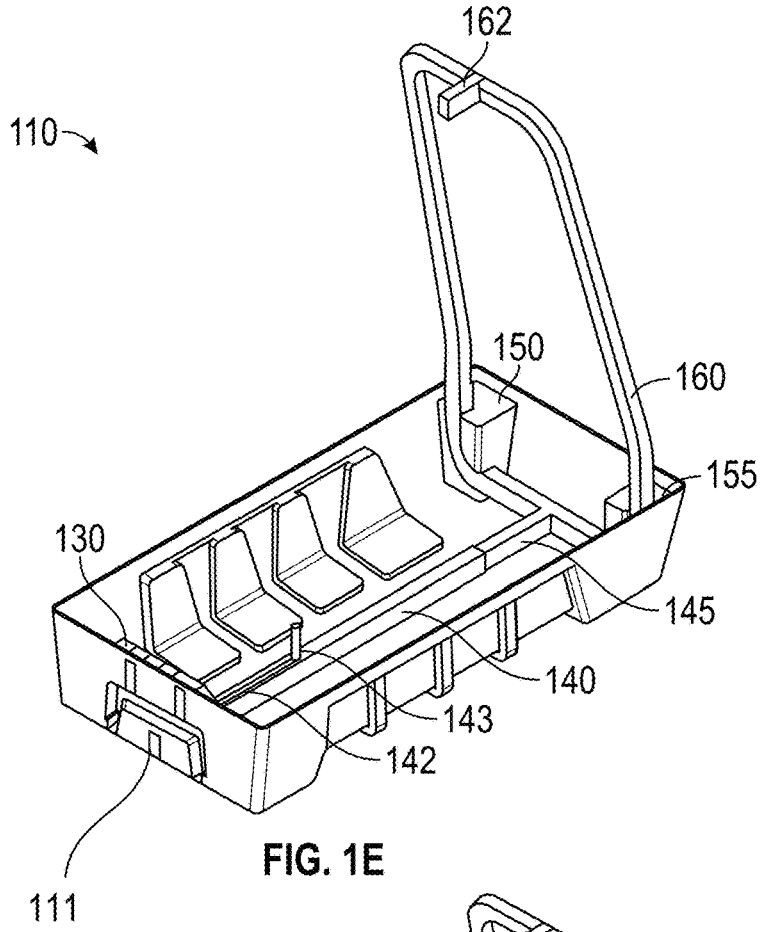
FIG. 1E illustrates a base portion of the collapsible case of FIG. 1A including a frame portion, a portion of a hinge assembly, and a portion of a locking fastener in an unlocked configuration.
Figure 1F:
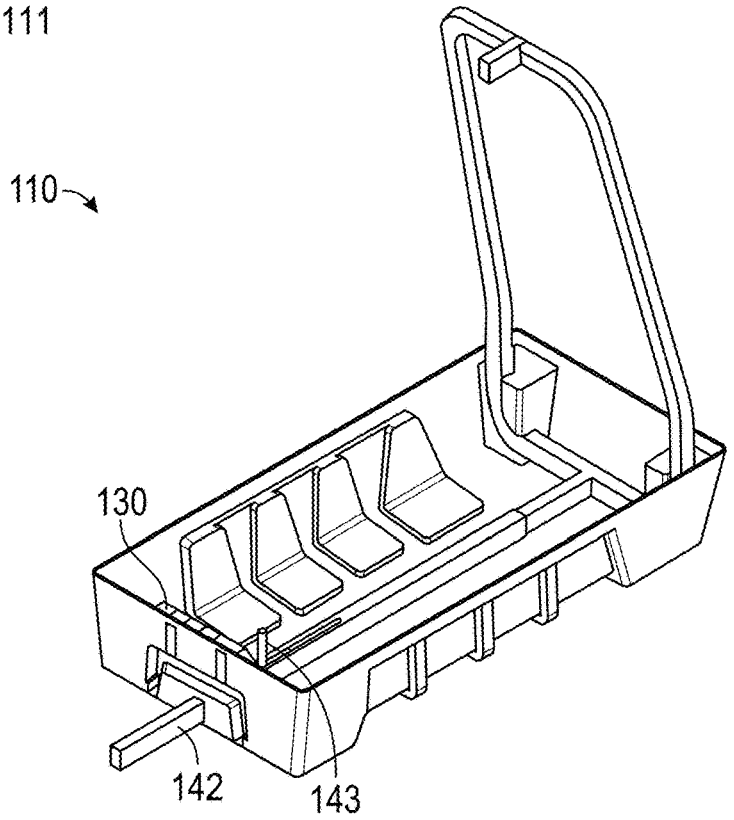
FIG. 1F illustrates the base portion of FIG. 1E with the portion of the locking fastener in a locked configuration.
Figure 1G:
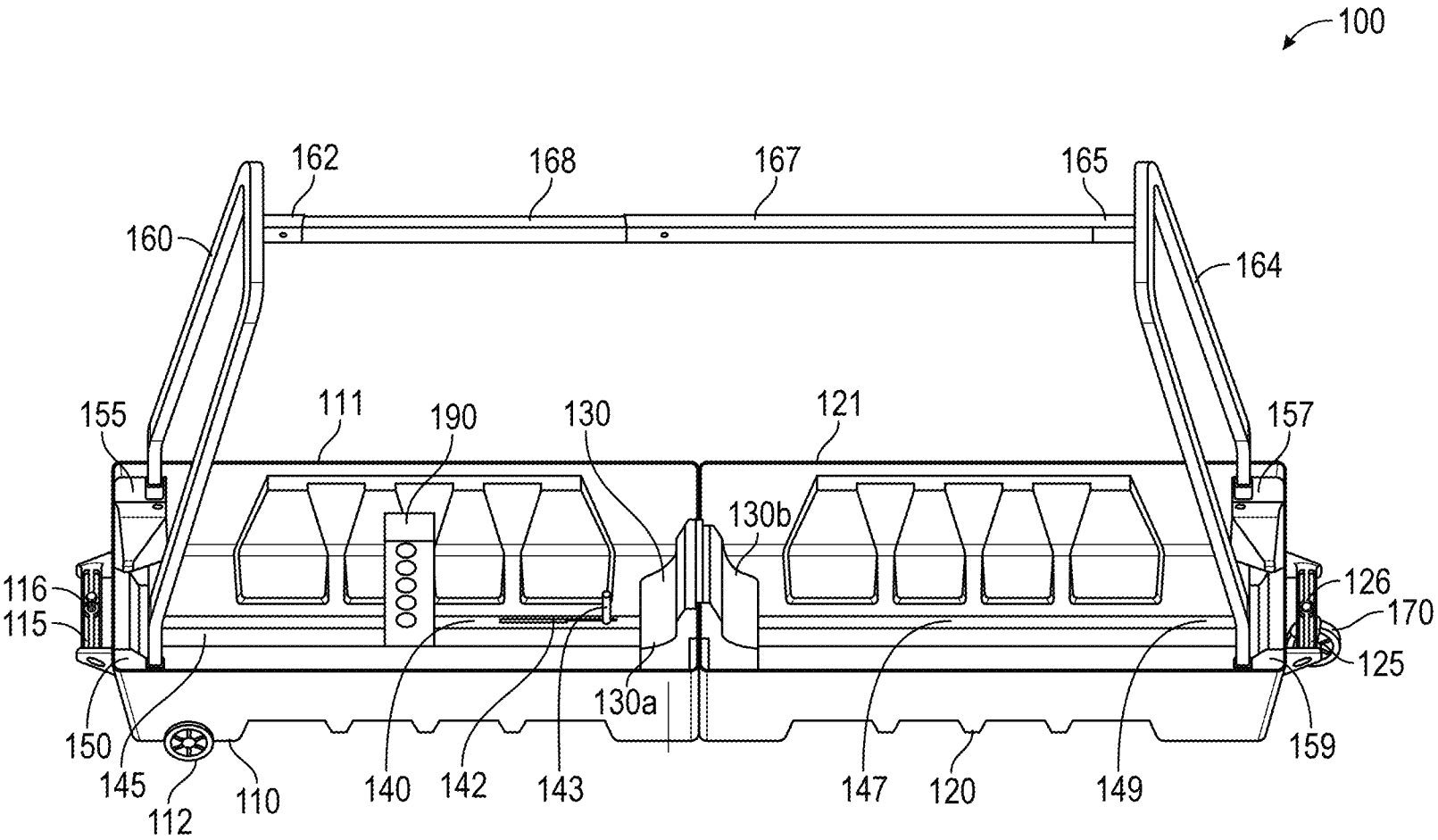
FIG. 1G illustrates the collapsible case of FIG. 1A in an open configuration.
Figure 1H:
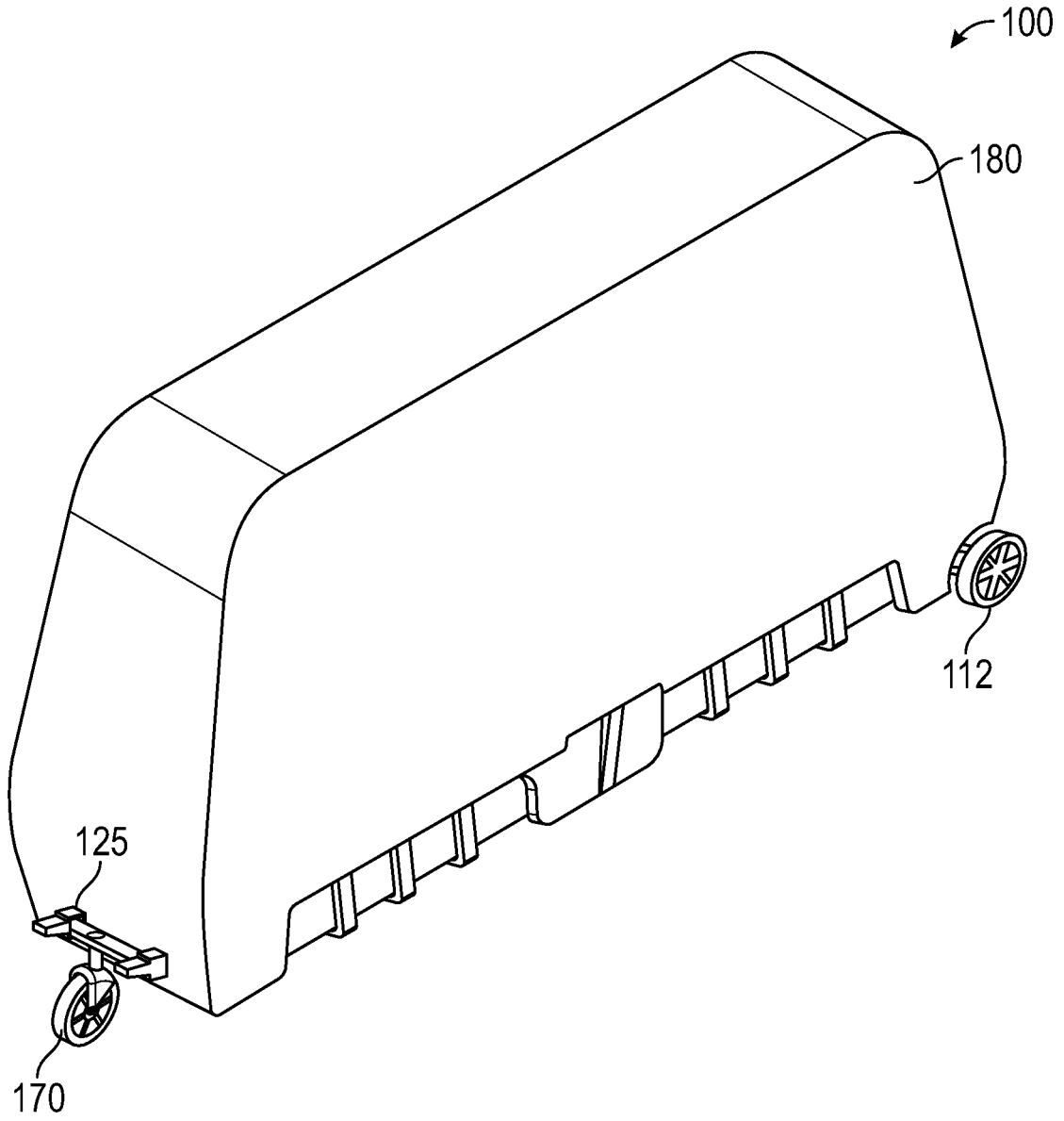
FIG. 1H illustrates the collapsible case of FIG. 1A in an open configuration with an upper and third wheel attachment.

FIGS. 1A-1I illustrate a collapsible case of the disclosure and components thereof. Collapsible case 100 comprises a base having a first base portion 110 and a second base portion 120 movably coupled to one another via a hinge assembly 130 having first side component 130*a* and second side component 130*b*, a frame assembly, and an upper cover. FIGS. 1A-1B illustrate collapsible case 100 in a closed or collapsed configuration where the first upper edge portion (or mouth) 111 of the first base portion 110 and the second upper edge portion (or mouth) 121 of the second base portion 120 are aligned and can be held and/or fastened together, for example, via a latch, zipper, magnets, and/or other suitable fastener. FIG. 1C illustrates first base portion 110 and second base portion 120 during an adjustment via hinge assembly 130 between collapsed and open configurations. FIGS. 1E-1F illustrate first base portion 110 including a portion of hinge assembly 130, a portion of the frame assembly, and a portion of the locking fastener in an unlocked and locked position. FIG. 1G illustrates collapsible case 100 in an open configuration with the frame assembly fully extended and assembled (use configuration) and configured to hold a fully assembled bicycle and/or a bicycle frame and separate wheels. FIG. 1H illustrates collapsible case 100 in an open configuration with an upper 180 attached to the base and covering the frame assembly (as fully assembled and/or expanded/folded out) and object(s) stored therein. A third wheel 170, here a removable push-press wheel, has been removably coupled to secondary handle 125.

Collapsible case 100 can be considered to have a top portion, a bottom portion, a front portion, a rear portion, a left side portion, and a right side portion when in a collapsed configuration in an upright position, as shown in FIG. 1A. Collapsible case 100 can have a side to side length of between 5-30 inches, between 10-25 inches or any other suitable side to side length. Collapsible case can have a top to bottom height of between 20-50 inches, between 25-40 inches, between 25-35 inches, or any other suitable top to bottom height. Collapsible case can have a front to rear length of between 5-30 inches, between 10-25 inches or any other suitable side to side length. The top portion comprises handle 119, the bottom portion comprises a set of wheels 112 and secondary handle (or leg) 115, the front portion comprises the surface forming the lower surface portion of second base portion 120 (in an open configuration, as shown in FIG. 1G), the rear portion comprises the surface forming the lower surface portion of first base portion 110 (in an open configuration), the left side portion comprises the left side of case 100 coupled to a wheel of set of wheels 112 (visible in FIG. 1A), and the right side portion comprises the right side of case 100 coupled to wheel 112 (not fully visible in FIG. 1A). While collapsible case 100 has a set of wheels 112 comprising two wheels on opposite sides of first base portion 110, it should be appreciated that contemplated cases can comprise any suitable number of wheels coupled to any suitable portions thereof. Secondary handle (or leg) 115 is provided on a bottom portion of collapsible case 100, and comprises a central portion 116 configured to removably couple to a removable wheel. As shown in FIG. 1G, contemplated cases can comprise multiple secondary handles (or legs) 115, 125, which can act as legs having four prongs when case 100 is in a collapsed configuration in an upright position, and as exterior handles to pick up the case when case 100 is in an open configuration. Similarly to secondary handle 115, secondary handle 125 can comprise a central portion 126 configured to removably couple to a removable wheel (e.g., a push-press wheel). The removable wheel can make the collapsible case rollable when the case is in an open configuration.

FIG. 1D illustrates a handle assembly comprising a first external cover or handle receiving portion 117 configured to couple to first base portion 110, which is configured to permanently or removably couple to handle 119 (e.g., via one or more screw or other fasteners, snap fit joints, releasable securing mechanisms (e.g., a releasable catch), or via any other suitable mechanism). It should be appreciated that in some embodiments, a base portion can comprise an external cover as a part of the base portion, and in some embodiments, an external cover can comprise a separate piece of material removably or permanently coupled to the base portion. First external cover 117 can comprise a recess and/or a recess can be formed between first external cover 117 and first base portion 110 that is sized and dimensioned to receive a portion of handle 119 when it is moved from a use position (shown in FIGS. 1A-1B), to a store position where handle 119 is moved about 90 degrees such that a side portion of handle 119 is positioned in the recess. The handle assembly can comprise a second external cover or handle receiving portion 127 (additionally or alternatively to the first external cover 117), which can be configured to couple to second base portion 120 and configured to couple to handle 119. Second external cover 127 can comprise a recess and/or a recess can be formed between second external cover 127 and second base portion 120 that is sized and dimensioned to receive a portion of handle 119 when it is moved from a use position (shown in FIGS. 1A-1B), to a store position where handle 119 is moved about 90 degrees. When collapsible case 100 is in an open configuration as in FIG. 1G and FIG. 1I, the two recesses of base portion 110 and base portion 120 (and/or of external covers 117 and 127) can horizontally align and form an enclosure for handle 119 such that there is no additional space needed between base portion 110 and base portion 120 to accommodate handle 119. Each of first external cover 117 and second external cover 127 can comprise an opening sized and dimensioned to allow a central slider 142 to pass from one base portion into another, as shown in FIGS. 1E-1G. Additionally or alternatively, each of base portion 110 and base portion 120 can comprise an opening (111 and 121, respectively) sized and dimensioned to allow a central slider 142 to pass from one base portion into another. It should be appreciated that handle 119 can be removed from one external cover and placed on the other based on a user's preference.

Figure 1I:
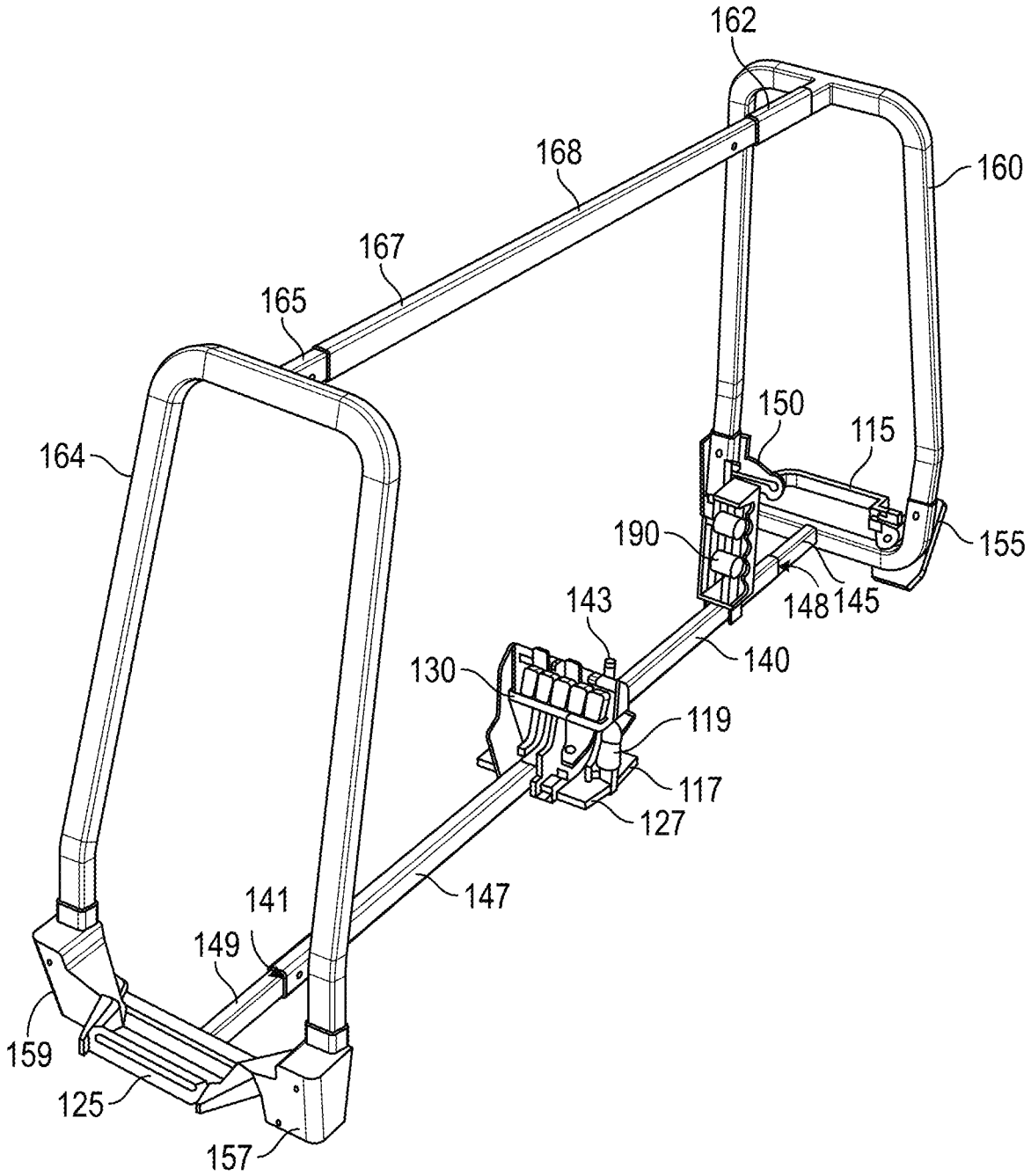
FIG. 1I illustrates the frame assembly of FIG. 1A in a use configuration with a hinge assembly, fork mount, external covers, a handle, and end pieces.

FIG. 1I illustrates the frame assembly and components thereof of collapsible case 100 coupled to a hinge assembly, fork mount, external covers, a handle, and end pieces. The frame assembly is shown in a use configuration comprising two side portions, a bottom portion and an upper portion. The bottom portion can be positioned in the compartments of base portions when case 100 is in an open configuration (and optionally also in the closed configuration). A first extrusion 147 of the bottom portion can be positioned in a compartment of second base portion, a second extrusion 140 of the bottom portion, which is slotted here, can be positioned in a compartment of first base portion (see FIG. 1G). As used herein, an "extrusion" includes any elongated component (e.g., e.g., a square tube, a square rod having a portion with a lumen sized and dimensioned to receive a portion of a central slider, a circular tube, a circular rod having a portion with a lumen sized and dimensioned to receive a portion of a central slider), which can be made of any suitable rigid materials (e.g., metal, aluminum, rigid plastic). The extrusion can have any suitable cross-sectional shape (e.g., a circular cross-section, a square cross-section, a rectangular cross-section). In some embodiments, the bottom portion of the frame assembly can comprise a locking fastener to prevent base portions and/or frame assembly from unwanted adjustments when the case is in an open configuration. For example, a locking fastener can include a central slider (see 142 of FIGS. 1E and 1F) coupled to a slider knob or handle 143 that extends through a slotted portion of second extrusion 140. A user can adjust the central slider 142 via slider knob 143 such that central slider 142 can be entirely positioned in first base portion 110's compartment, for example in second extrusion 140 (unlocked), or can be positioned partially in second extrusion 140 and partially in second base portion 120's compartment, for example, in first extrusion 147 (locked). When locked, an adjustment of first base portion 110 and second base portion 120 from the open configuration to the closed configuration can be blocked by central slider 142 (e.g., metal or other rigid material slider) extending through base portions 110 and 120 and/or external covers 117 and 127, and partially positioned within each of first extrusion 147 and second extrusion 140, for example, within lumen 141 of first extrusion 147, and lumen 148 of second extrusion 140. Viewed from another perspective, base portions 110 and 120 and/or external covers 117 and 127 can comprise openings that align when the case is in an open configuration, and such openings can be sized and dimensioned to allow a central slider 142 to slide between first base portion 110 and second base portion 120. In some embodiments, the openings can be approximately the same size as the central slider (e.g., having a diameter, length and/or width that is no greater than 120% or even 110% of the diameter, length and/or width of an outer perimeter of the central slider). It should be appreciated that the central slider can advantageously also act as a structural component that completes the frame assembly such that there is no gap or break between the first and second extrusions.

The upper portion of the frame assembly similarly comprises one or more extrusions (167, 168), which in some embodiments can be removable from the rest of the frame, for example, removable from the side portions of the frame assembly (e.g., for storing in collapsible case 100 in a closed configuration). Additionally or alternatively, the one or more extrusions of the upper portion of the frame assembly can be configured to be telescoping (e.g., the extrusions can have telescoping diameters). In some embodiments, an extrusion (e.g., 167, 168) can be removably coupled to an extrusion receiver or connector component (e.g., 165, 162) of a first side portion of the frame assembly via a locking push button assembly, a spring button telescopic lock/release assembly, and/or other suitable assembly. In some embodiments, the extrusion (e.g., 167) and connector component (165) can have telescoping diameters. The same extrusion or a second extrusion (e.g., 168) can be removably coupled to another connector component (e.g., 162) of a second side portion of the frame assembly. In some embodiments, the first and second extrusions can be removably coupled to one another via a locking push button assembly, a spring button telescopic lock/release assembly, and/or other suitable assembly.

The side portions of the frame assembly can each comprise an end assembly (145, 149), and a rib cage upright (160, 164). Each end assembly can comprise a U-shaped component and a connector component extending from the U-shaped component, each of which can be made of a metal, aluminum, a rigid plastic and/or any other suitable materials. The U-shaped component can comprise a mid-portion and two arms extending from opposite sides of the mid-portion. In some embodiments, each arm forms an angle of between 70-110 degrees with the mid-portion. The connector component can be configured to removably couple (e.g., adjustably couple) to an extrusion of the bottom portion of the assembly via a push button or other suitable assembly. In some embodiments, the connector component extends substantially orthogonally to the U-shaped component. In some embodiments, the connector component forms a T-shape with the mid-portion of the U-shaped component. In some embodiments, the connector component and the extrusion have telescoping diameters such that one component can telescope and slide over the other component. In some embodiments, the connector component is configured to slide around an outer surface portion of the extrusion of the bottom portion of the assembly. In some embodiments, the connector component is configured to slide within the lumen of the extrusion of the bottom portion. The rib cage upright (160, 164) can comprise an upside down or substantially upside down U-shaped component (e.g., each arm of the rib cage upright forming an angle of between 150-210 degrees with an arm of the end assembly), and a connector component (162, 165) that is configured to removably couple to an extrusion (e.g., 167, 168) of the upper portion of the frame assembly. In some embodiments, the connector component and the extrusion of the upper portion can have telescoping diameters and releasably couple to one another via a push button assembly, spring button assembly, and/or any other suitable assembly. The upside down U-shaped component of the rib cage upright can similarly comprise a mid-portion and two arms extending from opposite sides of the mid-portion. In some embodiments, each arm forms an angle of between 70-110 degrees with the mid-portion. The connector component of the rib cage upright can be configured to couple (e.g., adjustably and/or removably couple) to an extrusion (e.g., 167, 168) of the upper portion of the assembly. In some embodiments, the connector component extends substantially orthogonally to the U-shaped component. In some embodiments, the connector component forms a T-shape with the mid-portion of the U-shaped component. In some embodiments, the connector component (162, 165) is slidably and coupled to an extrusion (167, 168) of the upper portion of the assembly. In some embodiments, the connector component (162, 165) is configured to slide within a recess or opening of the extrusion of the upper portion of the assembly. In some embodiments, the connector component is configured to slide around an outer surface portion of the extrusion of the upper portion of the assembly.

In some embodiments, the arms of the U-shaped portion of an end assembly (e.g., 145) and the arms of the upside down U-shaped portion of a rib cage upright (e.g., 160) can couple to one another to form an unbroken side frame (e.g., a trapezoidal frame, a rectangular frame) as shown in FIG. 1I. In some embodiments, an arm of the rib cage upright and an arm of the end assembly can have telescoping diameters. In some embodiments, an arm of the rib cage upright and an arm of the end assembly releasably couple to one another via a push button assembly, spring button assembly, and/or any other suitable assembly.

In some embodiments, a collapsible case 100 can comprise one or more end pieces (E.g., 150, 155, 157, 159) which can be configured to securely and/or releasably receive a portion of the side portions (e.g., the arms of the end assemblies) when the frame is in a use configuration. For example, each end piece can comprise a recessed portion sized and shaped to receive a portion of the frame via a press fit. In some embodiments, the end pieces can be made of a plastic and the frame can be made of a metal. In some embodiments, the end pieces can be mounted on or affixed within the compartments of the base of the collapsible case.

FIG. 1I illustrates the frame assembly as assembled and or expanded such that it extends out of the base compartments and can hold/secure/frame an object (e.g., a bicycle, a bicycle frame). To close a case, the extrusions of the upper portion (167 and 168) can be removed from connector components 162 and 165, respectively (e.g., by pressing down on the press pin extending through openings of the extrusion and the connector component, and sliding the extrusion away from the connector component (or vice versa)). The extrusions 167, 168 can optionally be separated from one another for storage purposes. The rib cage uprights 160 and 164 can be removed from the end assemblies 145 and 149, respectively, for example, by pressing down on the press pin extending through openings of the arms of the rib cage upright and arms of the end assembly, and sliding the arms of the rib cage upright away from the arms of the end assembly (or vice versa).

In some embodiments, rib cage upright 160 (including connector component 162) and extrusion 168 can be placed within the compartment of base portion 110, and rib cage upright 164 (including connector component 165) and extrusion 167 can be placed within the compartment of base portion 120 such that the collapsible case can be closed/collapsed as shown in FIG. 1A with all components of the frame assembly stored therein. While the end assemblies can be removed from the extrusions of the bottom portion of the frame assembly, in some embodiments, they can remain coupled and the other components (e.g., rib cage upright and extrusion of upper portion) can still fit within the compartment such that no part of the frame sticks out above the mouth of the base portion.

While an example frame assembly is shown in FIG. 1I, it should be appreciated that any suitable frame assemblies that can be adjusted (e.g., folded down/extended out) and/or assembled/disassembled. In some embodiments, a bicycle fork mount 190 (e.g., made of plastic, metal) or other mount(s) and component(s) can be configured to slide on one or more frame components (e.g., extrusion 140) to adjust for bicycles (or other objects) of different sizes. In some embodiments, the fork mount 190 can slide and be locked in one or more positions along the length of the frame component.

The frame assembly can be of any suitable size and shape. For example, a frame assembly can have a top to bottom height of between 1-5 feet, between 2-4 feet, or about 3 feet (or any other suitable height, for example, depending on the object(s) being stored). The frame assembly can have a first length along the bottom portion of the frame assembly that is between 4-8 feet, between 5-7 feet, or about 6 feet (or any other suitable length, for example, depending on the object (s) being stored). The frame assembly can have a second length along the top portion of the frame assembly that is between 3-8 feet, between 4-7 feet, between 4-6 feet, or between 4-5.5 feet (or any other suitable length, for example, depending on the object(s) being stored).

The upper of a collapsible case can also have any suitable size and shape. For example, an upper can have a top to bottom height of between 1-6 feet, between 2-5 feet, or between 3-4 feet (or any other suitable height, for example, depending on the object(s) being stored). The upper can have a first length along the bottom portion of the upper that is between 4-8 feet, between 5-7 feet, or between 6-7 feet (or any other suitable length, for example, depending on the object(s) being stored). In some embodiments, the upper can have a first length that is the same as a length of the base in an open configuration. The upper can have a second length along the top portion of the upper that is between 4-10 feet, between 3-9 feet, between 4-8 feet, between 4-7 feet, or between 5-6 feet (or any other suitable length, for example, depending on the object(s) being stored). The upper can have a thickness or width that is between 0.5-5 feet, between 1-3 feet, or between 1-2 feet (or any other suitable thickness or width, for example, depending on the object(s) being stored).

Figure 2:
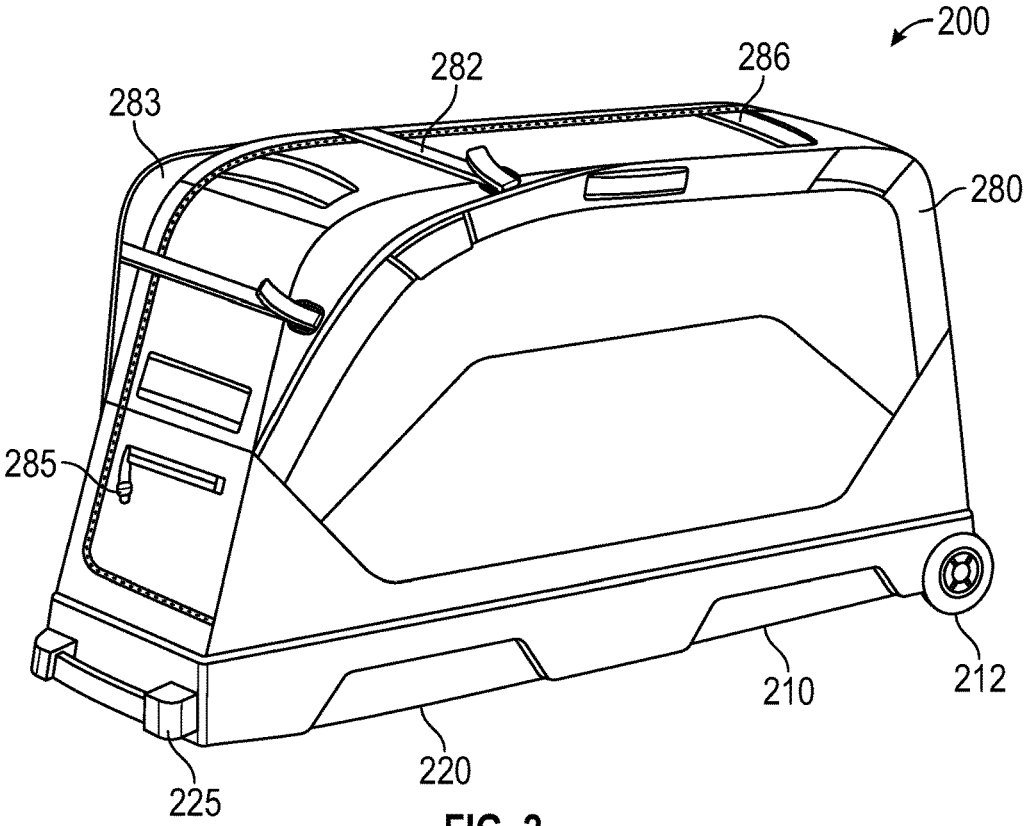
FIG. 2 illustrates another collapsible case of the disclosure, according to an embodiment.

FIG. 2 illustrates another collapsible case of the disclosure, according to an embodiment. Collapsible case 200 is illustrated in an open configuration wherein base portion 210 and base portion 220 have been folded open similarly to base portions 110 and 120 in FIG. 1G-1H. Collapsible case 200 can include some or all of the components of collapsible case 100, including a frame assembly, hinge assembly, etc. Collapsible case 200 a secondary handle or leg 225, and a set of wheels 212. Collapsible case 200 further comprises an upper cover 280, which includes a zippered pocket 285, handle 286, and adjustable straps (e.g., 282) that couple to expandable portions or wings (e.g., 283) of upper cover 280. As described above, upper cover 280 can be permanently or removably attached to base portions 210 and 220, and can be sized and dimensioned to fully enclose (with base portions 210, 220) the frame assembly (as fully assembled or expanded) and a bicycle or other object. In some embodiments, the bicycle wheels can be separated from the bicycle frame and placed within collapsible case 200. In some embodiments, a fully assembled bicycle can be enclosed within collapsible case 200. The expandable portions 283 can comprise an extra piece of material added between first and second pieces/edges of upper cover 280. Here, adjustable straps 282 can be loosened such that the expandable portions can be expanded (e.g., exposing/making usable the extra pieces of material), or tightened such that the expandable portions are folded down/not expanded (e.g., where the first and second pieces/edges come together such that the extra pieces of material cannot be flattened/used). It should be appreciated that expandable portions can be used, for example, to accommodate handlebars of a bicycle stored in the collapsible case when the case is in an open configuration. While adjustable straps are shown in the embodiment of FIG. 2, it should be appreciated that the expandable portion can be adjusted in any suitable manner. For example, a zipper or other fastener can be used to fasten the first and second pieces/edges of upper cover 280 together, and the extra piece of material can form a pocket that is enclosed by the zipper.

Figure 3A:
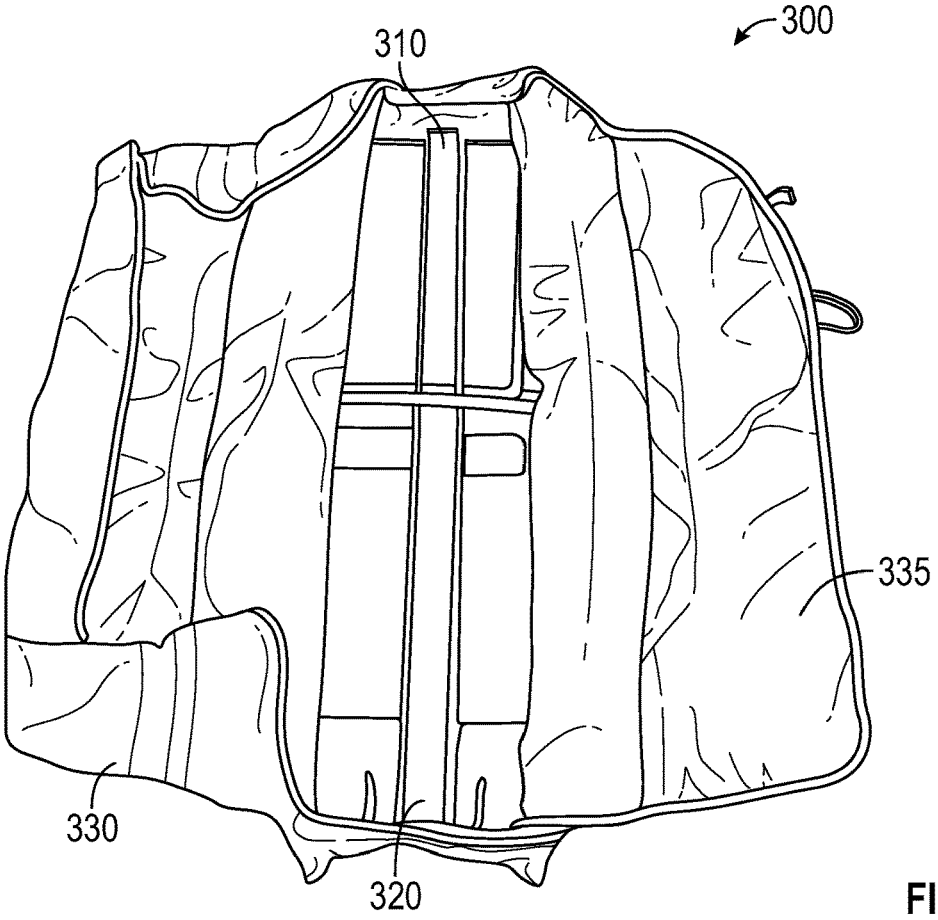
FIG. 3A illustrates another collapsible case of the disclosure with a frame removed, according to an embodiment.
Figure 3B:
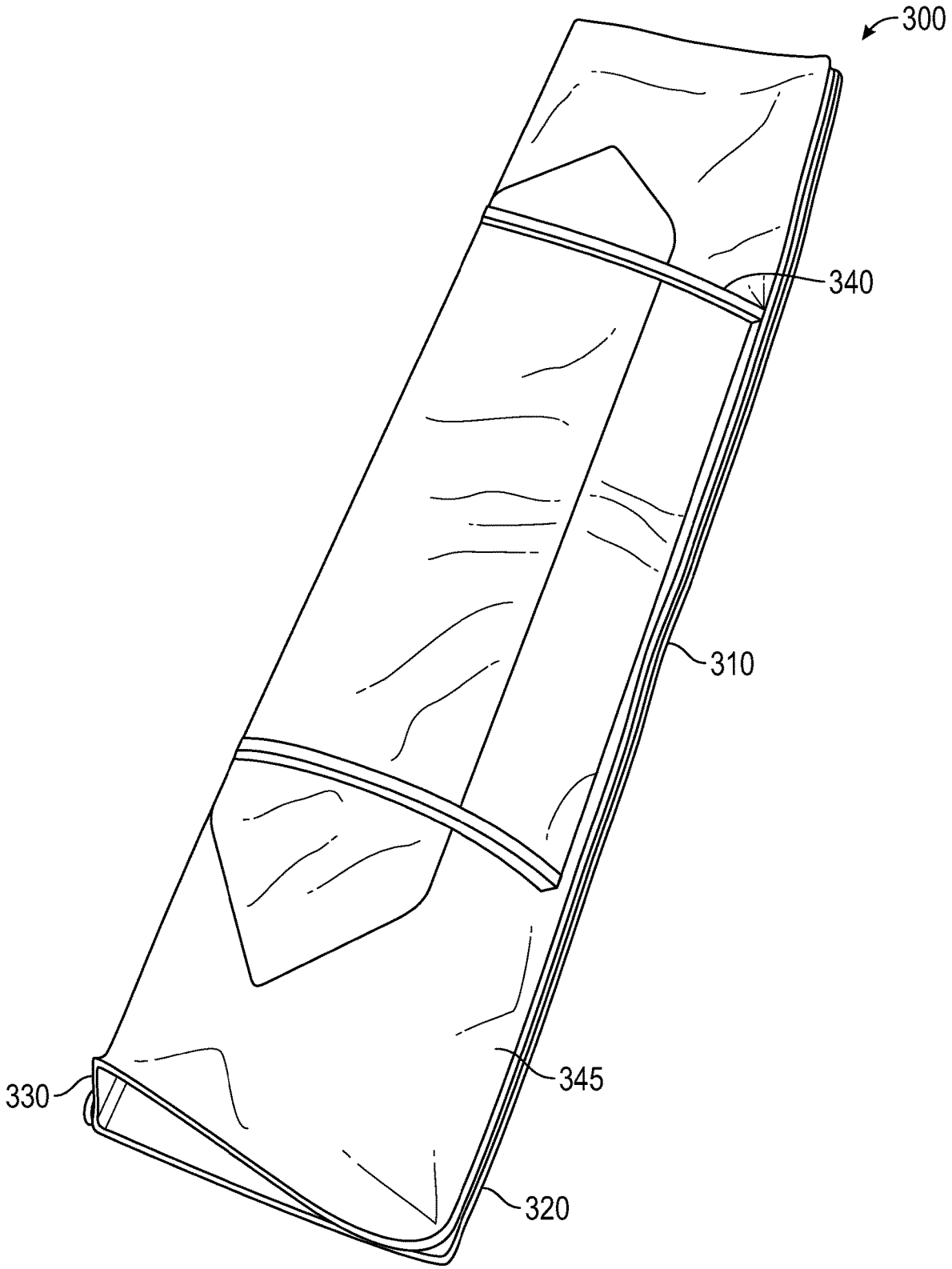
FIG. 3B illustrates the collapsible case of FIG. 3A with the upper folded into down.

FIGS. 3A-3E illustrate another collapsible case of the disclosure with a frame removed. In FIG. 3A, collapsible case 300 comprises first base portion 310, second base portion 320, and an upper cover that comprises a first portion 330 and a second portion 335. It is contemplated that one or more zippers or other fasteners can be coupled to first portion 330 and second portion 335 such that they can fasten to one another to form a cover (e.g., similar to upper cover 280 in FIG. 2). In some embodiments, first portion 330 can be configured to removably couple to one or both of base portions 310, 320 via one or more fasteners (e.g., hook and loop, snaps, zippers), and second portion 335 can be configured to removably couple to one or both base portions 310, 320 via one or more fasteners. In some embodiments, first portion 330 can be removed from the base and folded to fit within a compartment of a base portion (e.g., 310, 320), and second portion 335 can be removed from the base and folded to fit within a compartment of the other base portion such that case 300 can be closed and enclose the entire upper cover. Alternatively or additionally, first portion of upper cover can remain coupled to one or both base portions and be folded down into the base compartment(s), and second portion of upper cover can remain coupled to one or both base portions (e.g., on an opposite side of the base portions from where the first portion of upper cover are coupled) and be folded down into the base compartment(s). One or more straps (e.g., 340) can be provided to secure the upper cover in the base compartment(s). Additionally or alternatively, first portion of upper cover can remain coupled the first base portion (but not the second base portion) and be folded down into a compartment of a first base portion, and second portion of upper cover can remain coupled to second base portion (but not the first base portion) and be folded down into the compartment of the second base portion.

Figure 3D:
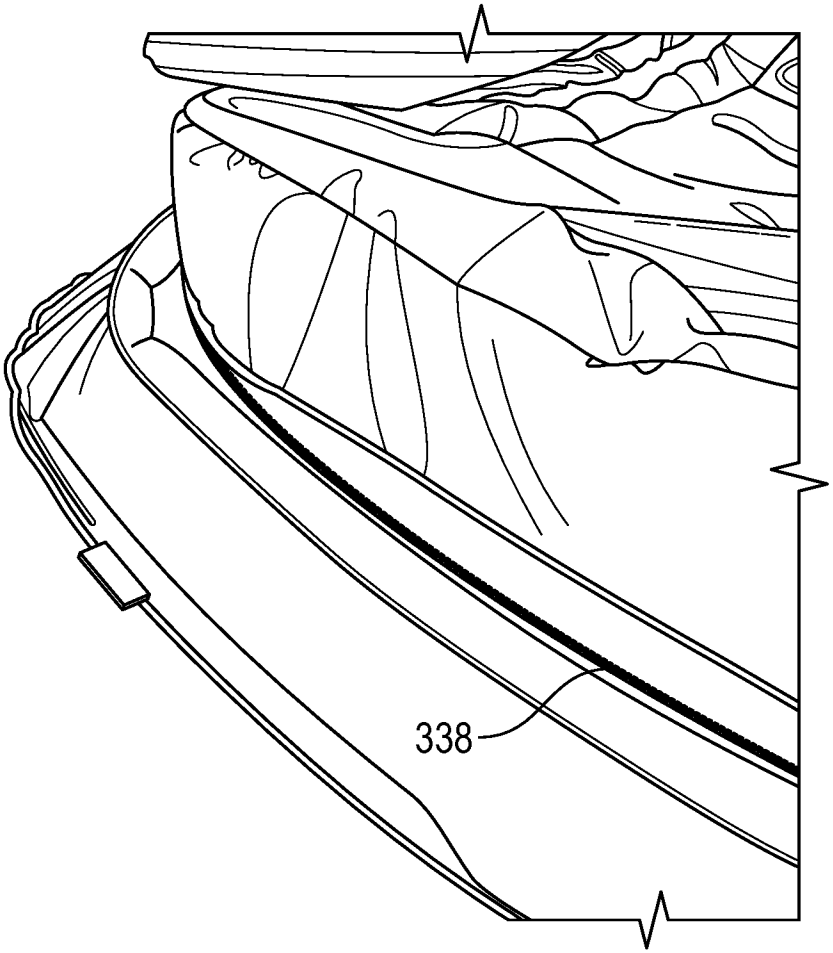
FIG. 3D is a close up view of a portion of the zippered compartment of FIG. 3C.
Figure 3C:
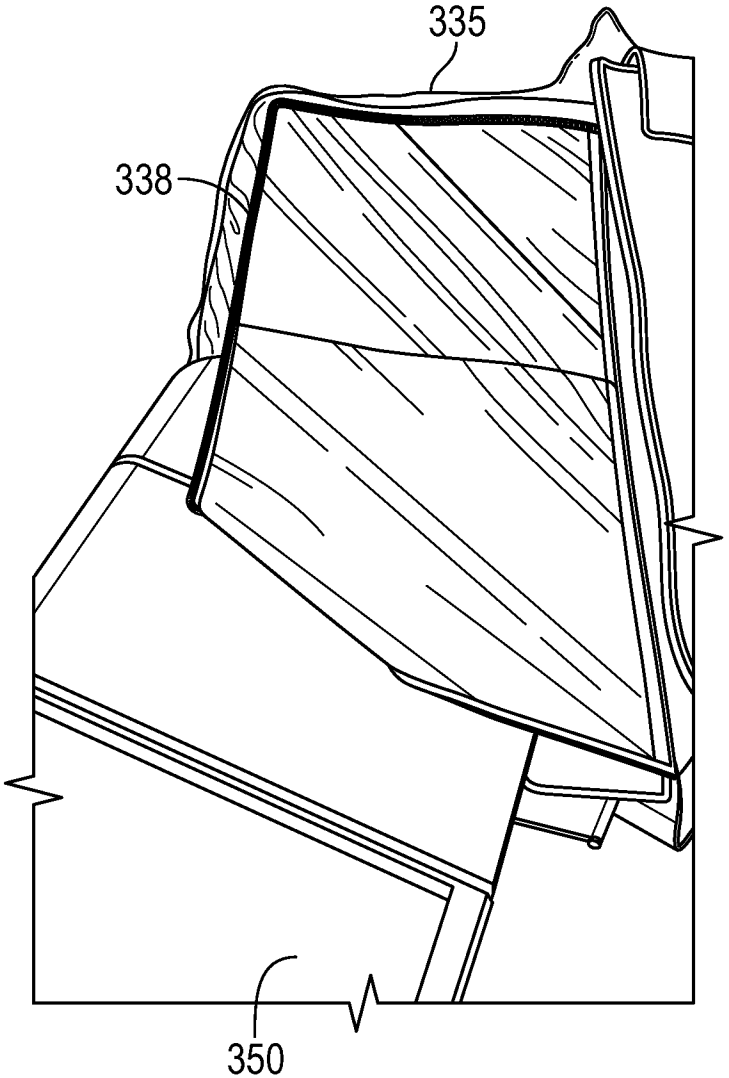
FIG. 3C illustrates a portion of the upper of the collapsible case of FIG. 3A including a zippered compartment sized and dimensioned to receive a protective device.
Figure 3E:
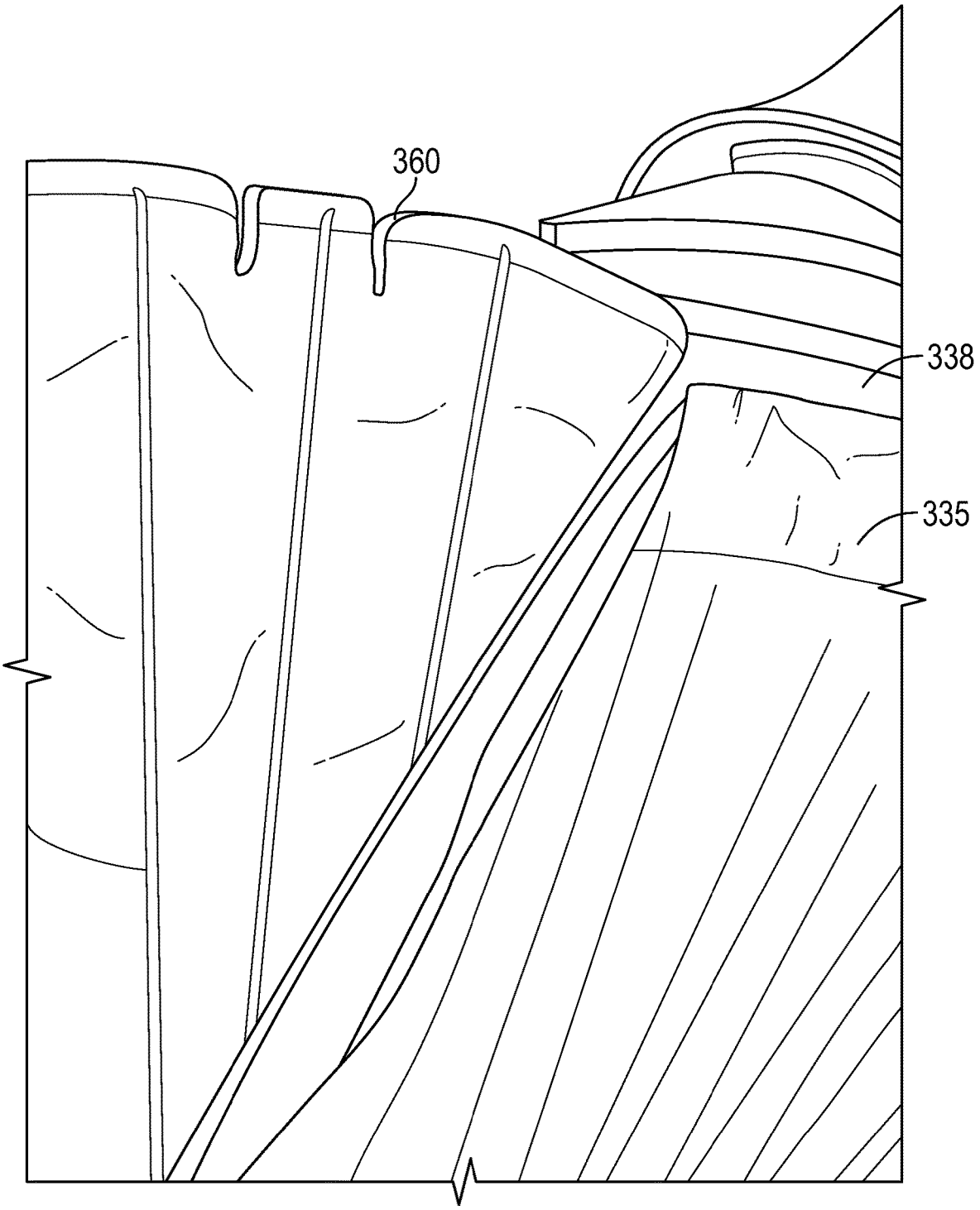
FIG. 3E illustrates an inflatable pad protective device being inserted into the zippered compartment of FIG. 3C.

As shown in FIG. 3C, upper cover (e.g., second portion 335 of upper cover) can comprise an enclosure sized and dimensioned to receive a protective device 350. The enclosure can comprise a zipper 338 or other fastener(s) that can be loosened (e.g., unzipped) to insert or remove protective device 350, and fastened (e.g., zipped) to prevent protective device 350 (e.g., a corrugated PP board) from being removed from the enclosure. It should be appreciated that the enclosure can be of any suitable size and shape. In some embodiments, the enclosure is trapezoidal. In some embodiments, the enclosure can be sized and dimensioned to receive a protective device having a length of at least 3 feet, at least 4 feet, at least 5 feet, or at least 6 feet, and/or having a height of at least 1 foot, at least 2 feet, at least 3 feet. As shown in FIG. 3D, the enclosure can be sized and dimensioned to receive a protective device having a thickness of at least 1 inch, at least 2 inches, or at least 3 inches. Viewed from another perspective, the enclosure can have a length of at least 3 feet, at least 4 feet, at least 5 feet, or at least 6 feet, and/or a height of at least 1 foot, at least 2 feet, at least 3 feet, and/or a thickness or width of at least 1 inch, at least 2 inches, or at least 3 inches. As shown in FIG. 3E, an inflatable device 360 can be inflated and placed in the enclosure to protect an object (e.g., bicycle) stored in the collapsible case.

Figure 4A:
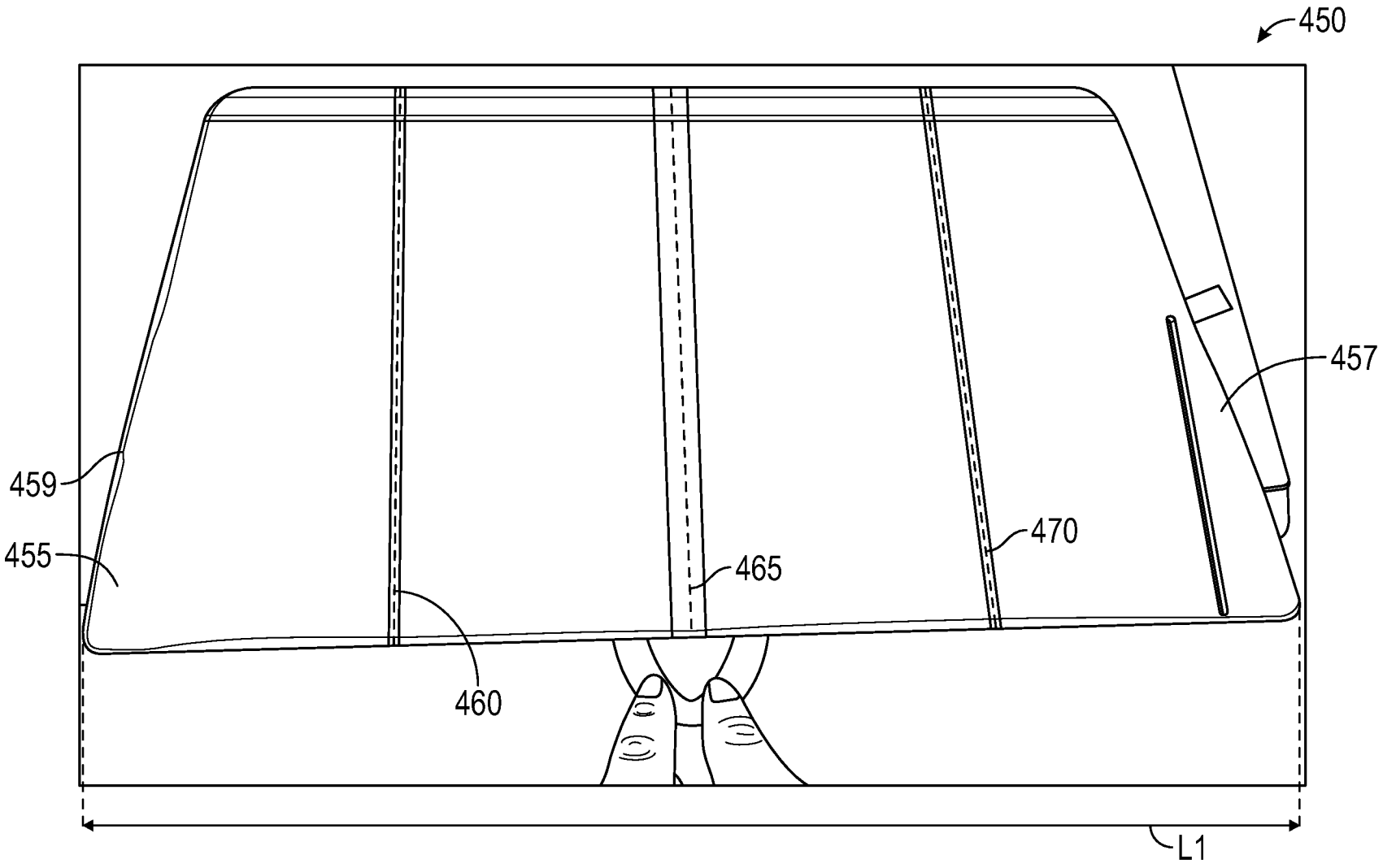
FIG. 4A illustrates a rigid and foldable protection device, according to an embodiment.
Figure 4B:
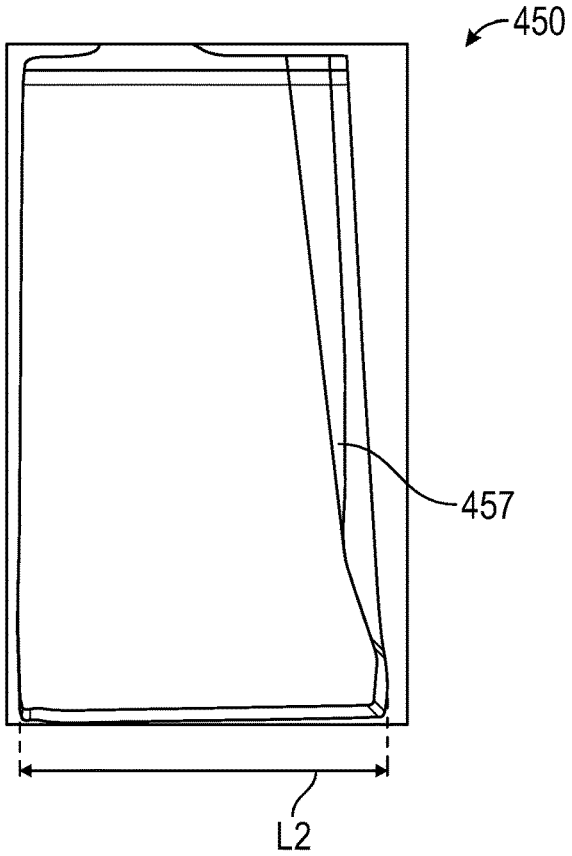
FIG. 4B illustrates the protection device of FIG. 4A after being folded down.
Figure 4C:
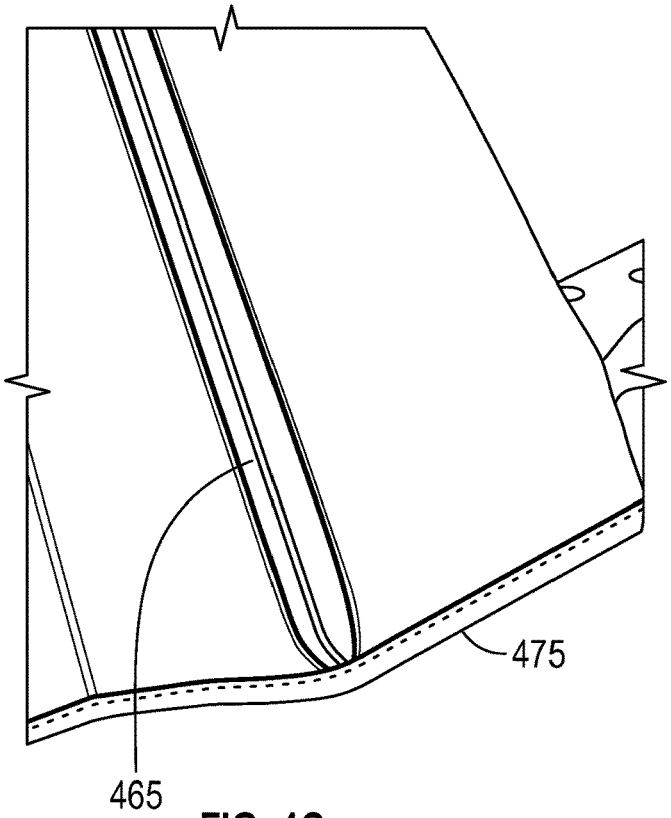
FIG. 4C is a close up view of a partial slit of the protection device of FIG. 4A.
Figure 4D:
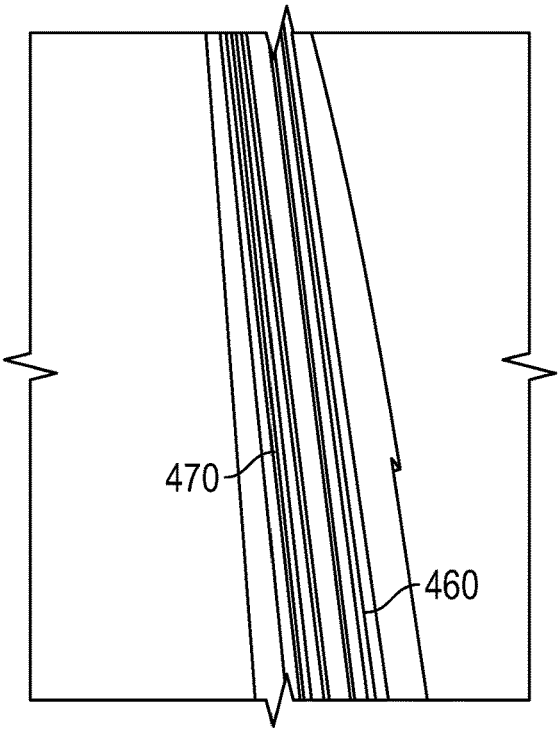
FIG. 4D is a partial side view of the folded protection device of FIG. 4B.
Figure 4E:
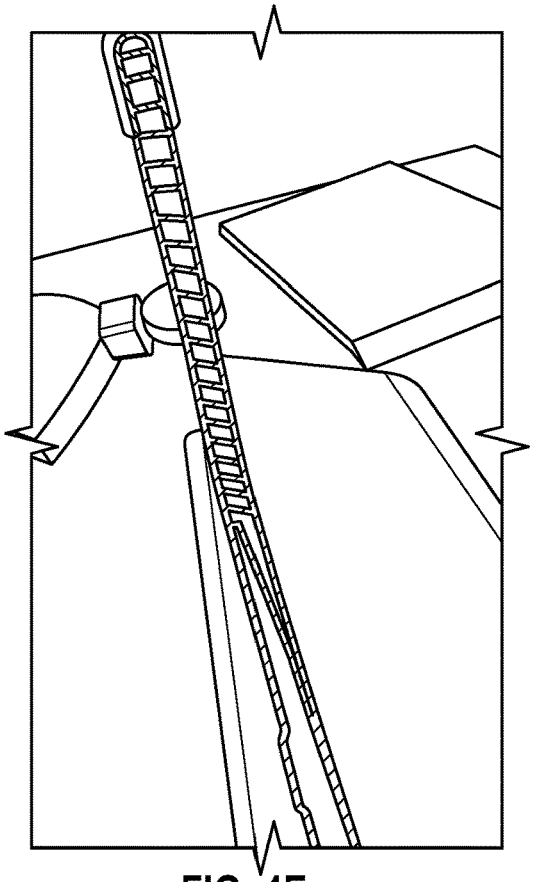
FIG. 4E is a cross-sectional view of a portion of the protection device of FIG. 4A.

FIGS. 4A-4E illustrate an example protective device 450, which can optionally be placed in an enclosure or sleeve of an upper cover and configured to protect an object stored in a collapsible case. Device 450 can be made of any suitable material(s) (e.g., a plastic, a metal, a wood, a padding, a foam, a rubber) and be of any suitable shape. Here, device 450 comprises a polypropylene (PP) flute board and has a generally trapezoidal shape to match a trapezoidal shape of an upper cover portion. The PP flute board is corrugated, as shown in FIG. 4E. Device 450 has a first side edge 459 and a second side edge 457. L1 can be any suitable length, for example, at least 1 foot, at least 1.5 feet, at least 2 feet, at least 2.5 feet, at least 3 feet, at least 3.5 feet, at least 4 feet, at least 4.5 feet, at least 5 feet, between 3-10 feet, between 5-7 feet, between 4-8 feet. Device 450 can have any suitable top to bottom height, for example, a height that is about 30-70%, or about 40-60% of L1. As shown in FIG. 4B, it is contemplated that be folded one, two, three, four, or even more times. Here, device 450 can fold along fold lines 460, 465, and 470. Alternating partial slits can be provided along the flutes along the fold lines, as best seen in FIG. 4C. The alternating partial slits allow the board to fold evenly, here, to four layers such that L2 is about 25% of L1. For example, where L1 is about 60 inches, L2 can be about 15 inches. Where a device is configured to fold to 5 layers (four fold lines), it is contemplated that L2 can be about 20% of L1. Where a device is configured to fold to 3 layers (two fold lines), it is contemplated that L2 can be about ⅓ of L1. As shown in 4C, a webbing 475 can be stitched or other coupled around the edges of device 450.

Figure 5:
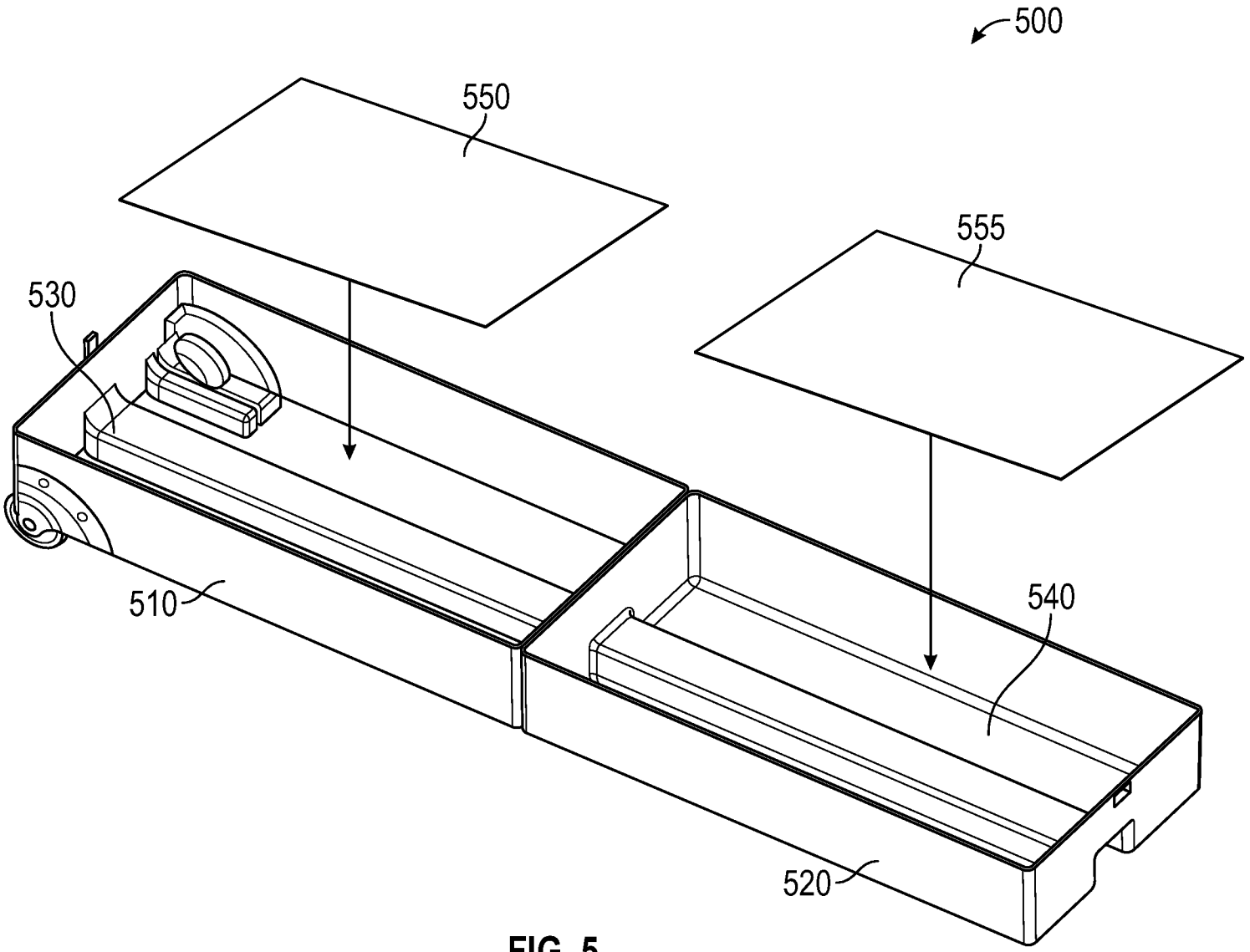
FIG. 5 illustrates a collapsible case with a foldable protection device and removable upper, according to an embodiment.

FIG. 5 illustrates a collapsible case with two foldable protection devices 530, 540 (each of which can be similar or identical to device 450) removed from the enclosures of upper cover portions 550, 555, respectively, and placed entirely within compartments of base portion 510 and base portion 520, respectively. and removable upper, according to an embodiment. Upper cover portions 550, 555 can be similar or identical to first portion 330 and second portion 335 of FIG. 3, which can removably attach to base portions 510 and 520, respectively, and zip to one another to form an upper cover that, with base portions 510 and 520, is configured to completely enclose a frame and/or bicycle and/or other object.

It should be appreciated that any suitable material(s) can be used for the frame assembly, base, and upper (upper cover). For example, a base can be made of a plastic, a metal, a wood, a steel, an aluminum, a high density polyethylene, a fiberglass reinforced polyester, a carbon fiber, or any other suitable material(s). A frame assembly can be made from a plastic, a metal, a wood, a steel, an aluminum, a high density polyethylene, a fiberglass reinforced polyester, a carbon fiber, or any other suitable material(s). An upper cover can be made of a fabric, a leather, a rigid and foldable panel, a polyester, a vinyl, a waterproof material, or any other suitable material(s).

Thus, specific examples of collapsible cases and components and accessories thereof have been disclosed.

The above description of the disclosed embodiments is provided to enable any person skilled in the art to make or use the invention. The preceding detailed description is merely exemplary in nature and is not intended to limit the invention or the application and uses of the invention. Various modifications to these embodiments will be readily apparent to those skilled in the art, and the general principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The illustrations may include exaggerated dimensions and graphical representation to better illustrate the referenced items shown, and are not considered limiting unless expressly stated as such.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

As used herein and in the appended claims, the singular forms "a," "an," and "the" include plural referents unless the context clearly dictates otherwise. It is further noted that the claims can be drafted to exclude any optional element. As such, this statement is intended to serve as antecedent basis for use of such exclusive terminology as "solely," "only" and the like in connection with the recitation of claim elements, or use of a "negative" limitation.

Also, as used herein, and unless the context dictates otherwise, the term "coupled to" is intended to include both direct coupling (in which two elements that are coupled to each other contact each other) and indirect coupling (in which at least one additional element is located between the two elements).

Reference throughout this specification to "an embodiment" or "an implementation" means that a particular feature, structure, or characteristic described in connection with the embodiment is included in at least one embodiment or implementation. Thus, appearances of the phrases "in an embodiment" in various places throughout this specification are not necessarily all referring to the same embodiment or a single exclusive embodiment. Furthermore, the particular features, structures, or characteristics described herein may be combined in any suitable manner in one or more embodiments or one or more implementations.

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed.

No language in the specification should be construed as indicating any non-claimed element essential to the practice of the invention.

Certain numerical values and ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating un-recited number may be a number which, in the context in which it is presented, provides the substantial equivalent of the specifically recited number.

Groupings of alternative elements or embodiments of the disclosure herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all groups used in the appended claims.

In the specification, reference may be made to the spatial relationships between various components and to the spatial orientation of various aspects of components as the devices are depicted in the attached drawings. However, as will be recognized by those skilled in the art after a complete reading of the present application, the devices, members, devices, etc. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Combinations, described herein, such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, and any such combination may contain one or more members of its constituents A, B, and/or C. For example, a combination of A and B may comprise one A and multiple B's, multiple A's and one B, or multiple A's and multiple B's.

All structural and functional equivalents to the components of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A collapsible case, comprising:

a base adjustable between an open configuration and a closed configuration, the base having a first base portion movably coupled to a second base portion via a hinge assembly, wherein the first base portion comprises a first compartment formed in part by a first wall portion comprising a first opening therethrough, wherein the second base portion comprises a second compartment formed in part by a second wall portion comprising a second opening therethrough;

wherein the hinge assembly comprises a first side component and a second side component;

a frame adjustable between an expanded configuration and a collapsed configuration, the frame comprising a first extrusion secured inside the first compartment by the first side component of the hinge assembly, and a second extrusion secured inside the second compartment by the second side component of the hinge assembly;

wherein the frame comprises a slider positioned at least partially within a lumen of the first extrusion;

wherein, in the closed configuration, a top surface of the base is formed by the first wall portion having the first opening and the second wall portion having the second opening;

wherein, in the open configuration, the first opening and the second opening align such that at least a portion of the slider can slide out from within the lumen of the first extrusion that is secured inside first compartment, through the first opening and the second opening, and into a lumen of the second extrusion secured inside of the second compartment to lock the base in the open configuration and act as a structural component that completes a bottom portion of the frame;

wherein the frame is configured to secure a bicycle frame upright when in an expanded configuration.

2. The collapsible case of claim 1, further comprising a first fastener coupled to the base and configured to fasten the first and second base portions to one another in the closed configuration.

3. The collapsible case of claim 2, wherein the first fastener comprises a zipper coupled to a first upper edge portion of the first base portion and a second upper edge portion of the second base portion.

4. The collapsible case of claim 1, wherein the bottom portion of the frame is between 4-8 feet.

5. The collapsible case of claim 1, wherein a length of the base in the open configuration is about 200% of the length of the base in the closed configuration.

6. The collapsible case of claim 1, wherein the frame further comprises additional components that can be stored within the first and second compartments of the collapsible case when the base is in the closed configuration, and assembled to form a bicycle frame that extends out of the first and second compartments.

7. The collapsible case of claim 1, further comprising an upper coupled to the base.

8. The collapsible case of claim 7, wherein the first compartment is further sized and dimensioned for storing at least a first portion of the upper.

9. The collapsible case of claim 8, wherein the upper is configured to be fully enclosed in the case when the base is in the closed configuration, and to extend from the base to form a covering sized and dimensioned to cover a bicycle frame when the base is in the open configuration.

10. The collapsible case of claim 9, wherein the case is sized and dimensioned to fully enclose a bicycle frame when the base is in an open configuration, and the upper is fully extended from the base to form the covering.

11. The collapsible case of claim 9, wherein the upper comprises an upper fastener.

12. The collapsible case of claim 1, further comprising a handle coupled to the top surface of the base.

13. The collapsible case of claim 12, wherein the top surface of the base comprises a first recessed portion sized and dimensioned to receive a first portion of the handle.

14. The collapsible case of claim 13, wherein the top surface of the base comprises a second recessed portion sized and dimensioned to receive a second portion of the handle.

15. The collapsible case of claim 14, wherein the first and second recessed portions are sized and dimensioned to face one another and wrap around the handle when the base is in the open configuration.

* * * * *